US007013679B2

(12) United States Patent
Mitchell, Jr. et al.

(10) Patent No.: US 7,013,679 B2
(45) Date of Patent: Mar. 21, 2006

(54) CLEANING CLOTH HAVING RUBBER YARN RIB ELEMENTS KNITTED THEREIN

(75) Inventors: Larry T. Mitchell, Jr., Thomasville, GA (US); William Martin, Quitman, GA (US)

(73) Assignee: Beech Island Knitting Company, Quitman, GA (US)

( * ) Notice: Subject to any disclaimer, the term of this patent is extended or adjusted under 35 U.S.C. 154(b) by 332 days.

(21) Appl. No.: 10/205,274

(22) Filed: Jul. 25, 2002

(65) Prior Publication Data

US 2004/0016444 A1 Jan. 29, 2004

(51) Int. Cl.
*D04B 21/20* (2006.01)

(52) U.S. Cl. ..... 66/170; 66/195

(58) Field of Classification Search ..... 66/170, 66/190–195; 15/209.1, 227, 229.11
See application file for complete search history.

(56) References Cited

U.S. PATENT DOCUMENTS 1,357,006 A * 10/1920 Schloss ..... 15/227
1,403,817 A * 1/1922 Pinson ..... 68/220
2,690,661 A * 10/1954 Briggs ..... 66/191
3,981,415 A * 9/1976 Fowler et al. ..... 222/95
4,142,334 A 3/1979 Kirsch et al.
4,352,846 A 10/1982 Passler et al.
4,600,620 A 7/1986 Lloyd et al.
4,888,229 A * 12/1989 Paley et al. ..... 428/192
4,987,632 A 1/1991 Rowe et al.
5,198,292 A 3/1993 Lerner et al.
5,613,263 A 3/1997 Nolte
5,657,648 A 8/1997 Ives et al.

* cited by examiner

*Primary Examiner*—Danny Worrell
(74) *Attorney, Agent, or Firm*—Jenkins, Wilson, Taylor & Hunt, P.A.

(57) ABSTRACT

A cleaning cloth for household and industrial use having a plurality of rubber yarns knitted therein and secured in a lock-stitch pattern. The plurality of rubber yarns formed as an integral part of the knitted fabric extend generally parallel to each other across the fabric and are of sufficient relative diameter to form spaced-apart rib elements and the rib elements are of sufficient size so as to serve as wiper blades to provide a squeegee effect during use of the cleaning cloth to remove dirt and debris from a hard surface being cleaned.

6 Claims, 6 Drawing Sheets

CLEANING CLOTH HAVING RUBBER YARN RIB ELEMENTS KNITTED THEREIN

FIELD OF THE INVENTION

The present invention relates to a cleaning cloth for household and industrial use which comprises a knitted fabric having a rubber yarn knitted therein which serves as a wiper blade or squeegee during use of the cleaning cloth.

RELATED ART

Cleaning and wiping cloths for household and industrial use are well known in the art. More specifically, it is well known in the cleaning cloth art to provide rubber surface bars on a cleaning cloth that function to perform a squeegee-like action. For example, U.S. Pat. No. 4,352,846 to Passler, et al. discloses a cleaning cloth for household and industrial use comprising a soft resilient needle punch non-woven fabric with a plurality of rubber strips mounted on one surface and having an underside formed by an open-pore foam-type layer which penetrates into the non-woven fabric. The rubber strips have a triangular profile to provide for good scraping action, and the rubber strips may be associated with one another in any desired pattern.

Similarly, U.S. Pat. No. 4,142,334 to Kirsch, et al. discloses a scouring and cleaning cloth designed to provide for improved effectiveness in wet cleaning against smeary and hardened substances. The cleaning cloth is provided with a binding agent printed in the form of super elevated bars offset from one another on both sides of the cleaning cloth, and the bars in at least one of the surfaces having an abrasive or soap additive embedded therein. Thus, when force is used to press the cloth downwardly, the bar-like structures will have a squeegee action to largely prevent the penetration of smeary substances into the porous surface of the textile support material.

The cleaning cloths disclosed and described in U.S. Pat. No. 4,352,846 and U.S. Pat. No. 4,142,334 are believed to be representative of the prior art wherein rubber strips or rubber blade-like elements are affixed to the top surface of a cleaning cloth to provide for enhanced cleaning effect. However, as would be well known to one skilled in the art, there remains a need for a new and improved cleaning cloth wherein rubber yarns are incorporated as an integral part of the cleaning cloth in order to form the blade or rib-like elements. The cleaning cloth of the present invention provides for superior squeegee-like cleaning action to better remove dirt and grime from a hard surface.

SUMMARY OF THE INVENTION

The present invention is directed to a cleaning cloth for household and/or industrial use and the method for producing the same. The cleaning cloth of the invention comprises a knitted fabric cleaning cloth having a plurality of rubber yarns knitted therein and each rubber yarn being secured by another yarn extending thereover in a lock-stitch pattern. The plurality of rubber yarns extend generally parallel to each other as they traverse the fabric and are of sufficient relative diameter to the fabric to form spaced-apart rib elements therein. The plurality of rib elements of the knitted fabric are of a size so as to function as wiper blades during use of the cleaning cloth to remove surface dirt and debris from a surface being cleaned.

Also provided is a method of cleaning surface dirt and debris from hard surfaces that includes providing a hard surface having undesirable surface dirt and/or debris thereon. Next, the hard surface is wiped with a cleaning cloth comprising a knitted fabric cleaning cloth with a plurality of rubber yarn knitted therein and each rubber yarn being secured by another yarn extending thereover in a lock-stitch pattern. The plurality of rubber yarns extend generally parallel to each other as they traverse the fabric and are of sufficient relative diameter to the fabric to form spaced apart rib elements therein, and the plurality of rib elements of the knitted fabric are of a sufficient size so as to function as wiper blades during use of the cleaning cloth to remove surface dirt and debris from the hard surface being cleaned.

Accordingly, it is an object of the present invention to provide an improved cleaning cloth for household and/or industrial use to remove surface dirt and debris from a hard surface.

It is another object of the present invention to provide an improved cleaning cloth for household and/or industrial use comprising a knitted fabric having a plurality of rubber yarns knitted therein. The plurality of rubber yarns serve to form spaced-apart rib elements that function as wiper blades during use of the cleaning cloth to remove dirt and debris from a hard surface being cleaned.

These and other objects of the present invention will become apparent to those skilled in the art after a reading of the following description of the preferred embodiment when considered with the drawings.

DETAILED DESCRIPTION OF A PREFERRED EMBODIMENT

The cleaning cloth of the present invention has been developed to provide a superior cleaning cloth for removing surface dirt and debris from a hard surface being cleaned. The cleaning cloth of the invention is intended for household and industrial use, and the cleaning cloth provides a novel construction wherein a plurality of rubber yarns are knitted therein which define spaced-apart rib elements to serve as wiper blades and to thereby perform a squeegee-like function during use of the cleaning cloth.

Figure 1A:
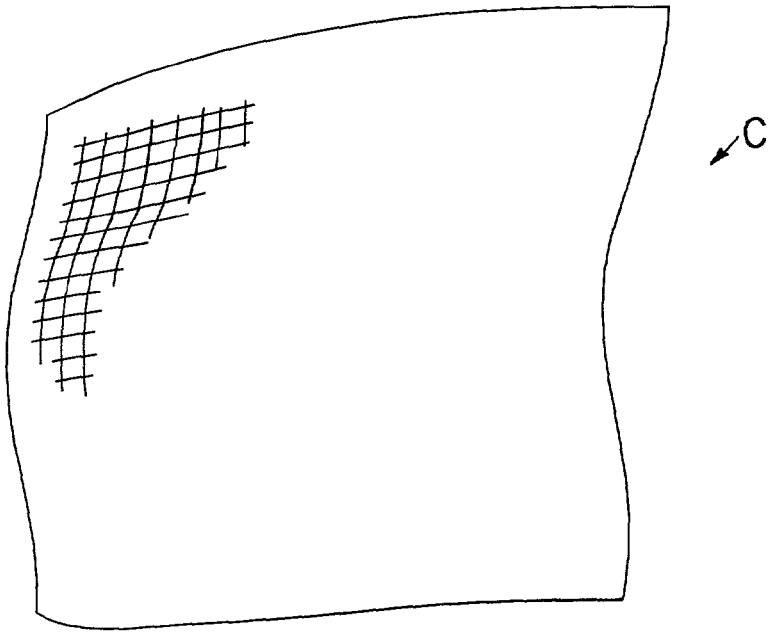
FIGS. 1A and 1B are a perspective view of a cleaning cloth and a cleaning cloth sponge, respectively, formed in accordance with the present invention.
Figure 1B:
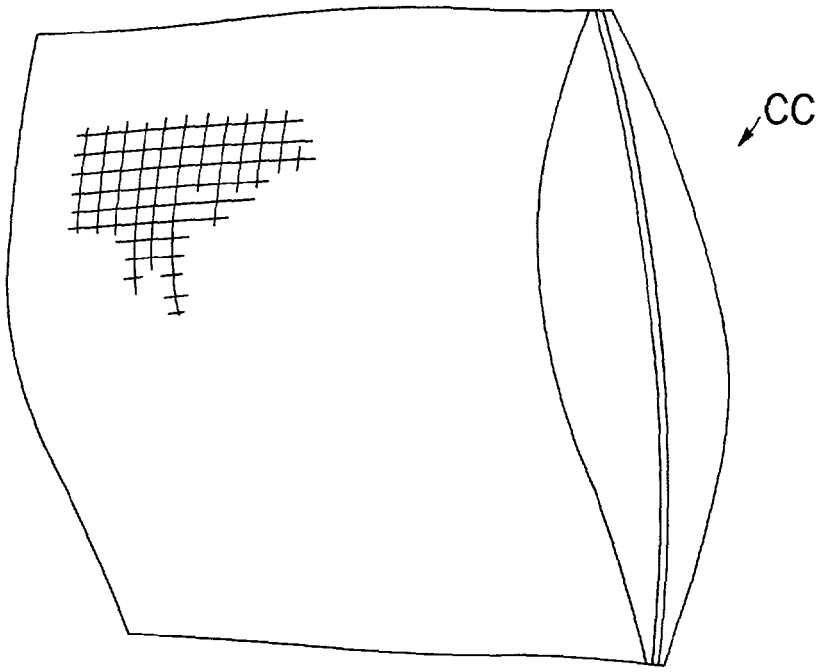

The cleaning cloth, generally designated C, is shown in FIG. 1 and can be used either alone (see FIG. 1A) or as a sponge-like cleaning cloth CC wherein a rubber or foam element is incorporated into a pouch formed from the cleaning fabric (see FIG. 1B).

Cleaning cloth C is formed from a knitted fabric cleaning cloth wherein a plurality of rubber yarns R are knitted therein and each of the rubber yarns R are secured by another yarn 34 (see FIG. 3) extending thereover in a lock-stitch pattern. In this manner, the plurality of rubber yarns R extend generally parallel to each other across the face of the cleaning cloth C and are of sufficient relative diameter to the cleaning cloth C as to form spaced-apart rib elements. Preferably, the rubber yarns R are between about 40 gauge and 26 gauge in size. The plurality of rib elements are of sufficient size so as to serve as wiper blades during use of the cleaning cloth C to remove dirt and debris from a hard surface or the like being cleaned.

Preferably, the rubber yarns R incorporated into the cleaning cloth C are covered rubber yarns, and the covered rubber yarns are about between about 40 gauge and 26 gauge in size and are available from North American Rubber Thread of Fall River, Mass. The knitted fabric can be formed from a variety of knitted yarns including cotton yarns, polyester yarns, and blended cotton polyester yarns. Furthermore, the knitted fabric preferably is formed from a set-up including a first bar of weft yarn, a second bar of rubber yarn, a third bar of weft yarn, and a fourth bar of warp yarn wherein the warp yarn serves to lock-stitch the rubber yarn R into the knitted fabric. The inventive cleaning cloth C is contemplated to be formed from a knitted fabric by a variety of knitting constructions including circular, flat bed, warp, crochet, and v-bed knitting. Most suitably the knit fabric of cleaning cloth C is a v-bed knitted fabric made in accordance with the teachings of Ives et al, U.S. Pat. No. 5,657,648.

The cleaning cloth C of the invention is contemplated to be used in many applications in which a highly effective cleaning cloth is desired that is non-abrasive in use. Furthermore, as will be noted hereinbelow, a preferred embodiment of the cleaning cloth invention provides for a polyester yarn chain stitch to lock the rubber yarns R into the knitted fabric construction, and the knitted fabric is formed so as to possess 2-way stretch that will facilitate sewing a seam around a sponge to form the cleaning cloth sponge embodiment CC shown in FIG. 1B. Representative uses for the cleaning cloth C include cleaning and removing food particles from dishes, pots, and pans. Further, the cleaning cloth C serves to very effectively remove bugs and debris from an automobile during washing of the automobile with the cleaning cloth C. The cleaning cloth C shown in FIG. 1A and the cleaning cloth sponge CC shown in FIG. 1B both work quite effectively with water, but the addition of a soap or detergent further enhances the effectiveness of the cleaning cloths.

Although the cleaning cloth C of the present invention can be formed with many different types of yarns and with many different types of fabric constructions and knitting machines, a representative and preferred embodiment of the cleaning cloth C for household and/or industrial use of the present invention is described in specific detail hereinbelow to enable one skilled in the art to construct a cleaning cloth in accordance with the present invention. This particular construction of cleaning cloth C has been found to work well, but many other constructions are possible and intended to be within the scope of the invention described and claimed herein.

METHOD OF MAKING FABRIC FOR CLEANING CLOTH

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 2:
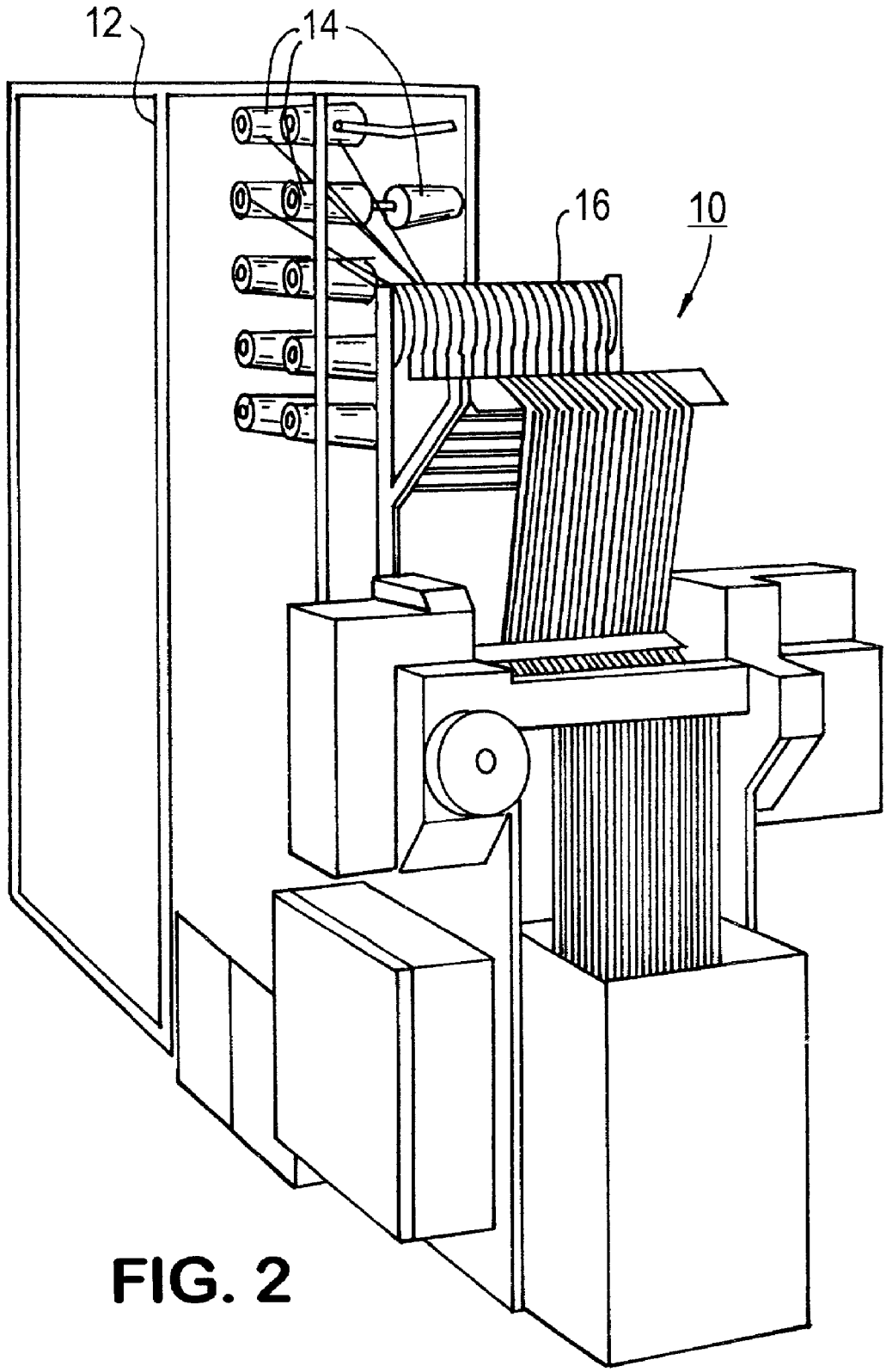
FIG. 2 is a front elevational view of a crochet knitting machine used to make the cleaning cloth of the present invention.

Referring now to the drawings in general and FIG. 2 in particular, it will be understood that the illustrations are for the purpose of describing a preferred embodiment of the invention and are not intended to limit the invention thereto. As best seen in FIG. 2, a crochet machine, generally designated 10, is shown adapted to construct the fabric for cleaning cloth C according to the present invention. The crochet machine 10 includes a creel 12 for supporting a plurality of yarn packages 14 for supplying warp and weft yarn to the machine. Warp yarn is taken out from a beam of yarn ends 16. According to the present invention, the crochet machine 10 is modified to use a tricot cam which is operable to knit on more than one needle to produces an anti-ravel fabric and which has bi-directional stretch since the stitch is not locked all the way across.

Figure 3:
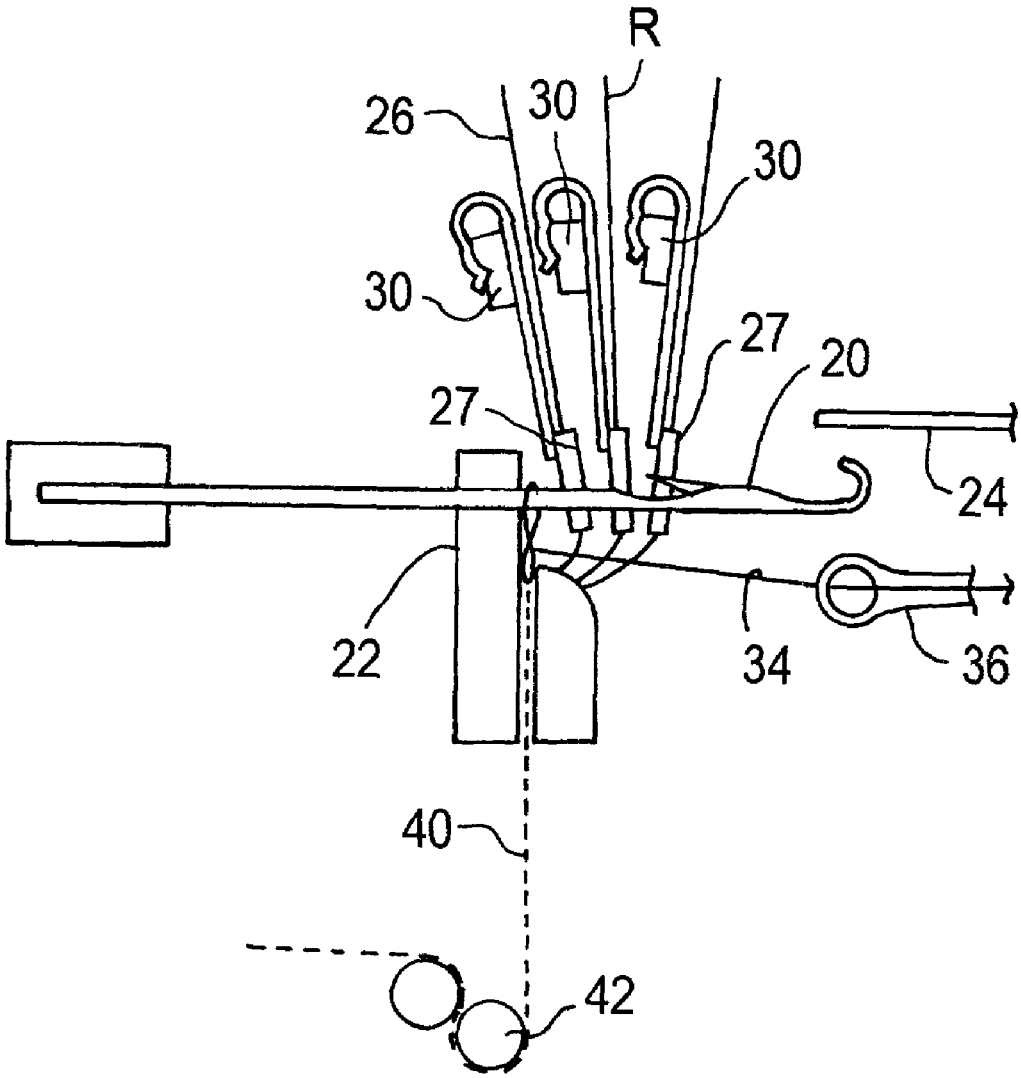
FIG. 3 is an enlarged front elevational view of the machine shown in FIG. 2 utilizing latch needles and latch guides and a lengthened lobe for increased dwell time.
Figure 4A:
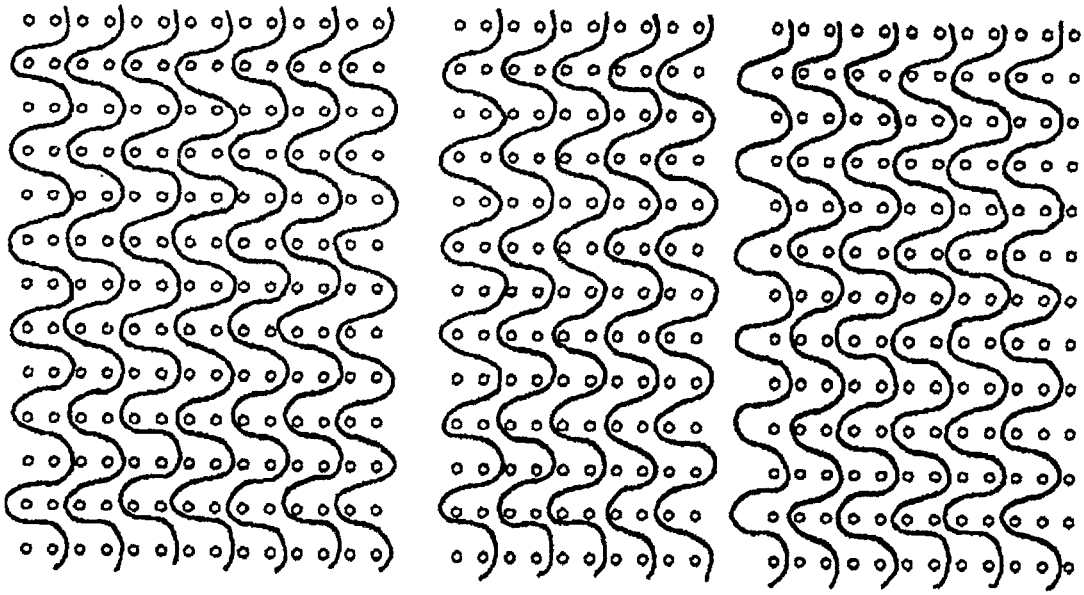
FIG. 4A is a stitch diagram illustrating bar number 1—weft yarn used to make the cleaning cloth of the present invention.
Figure 4B:
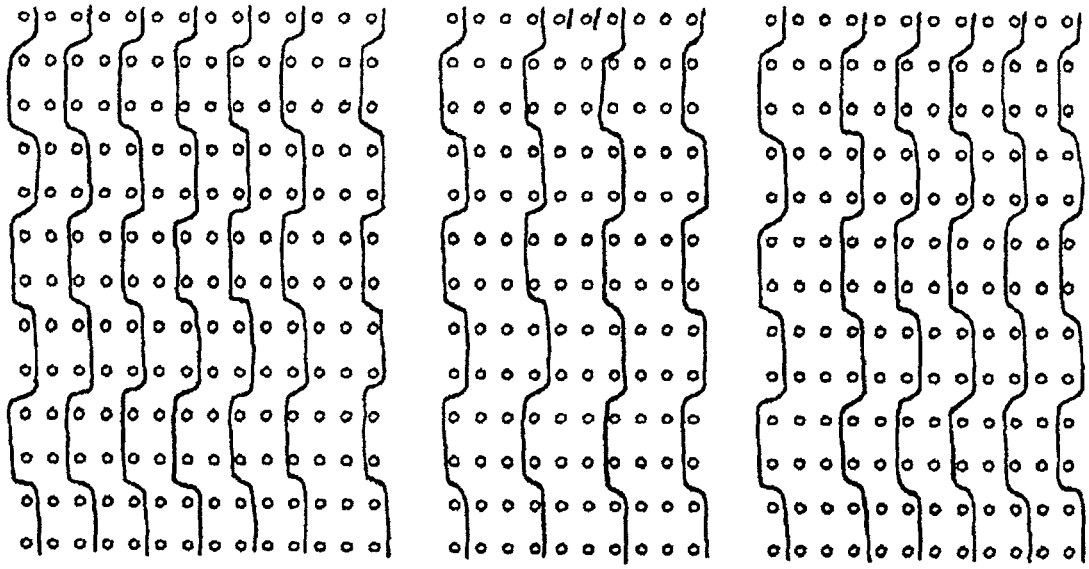
FIG. 4B is a stitch diagram illustrating bar number 2—covered rubber yarn.
Figure 4C:
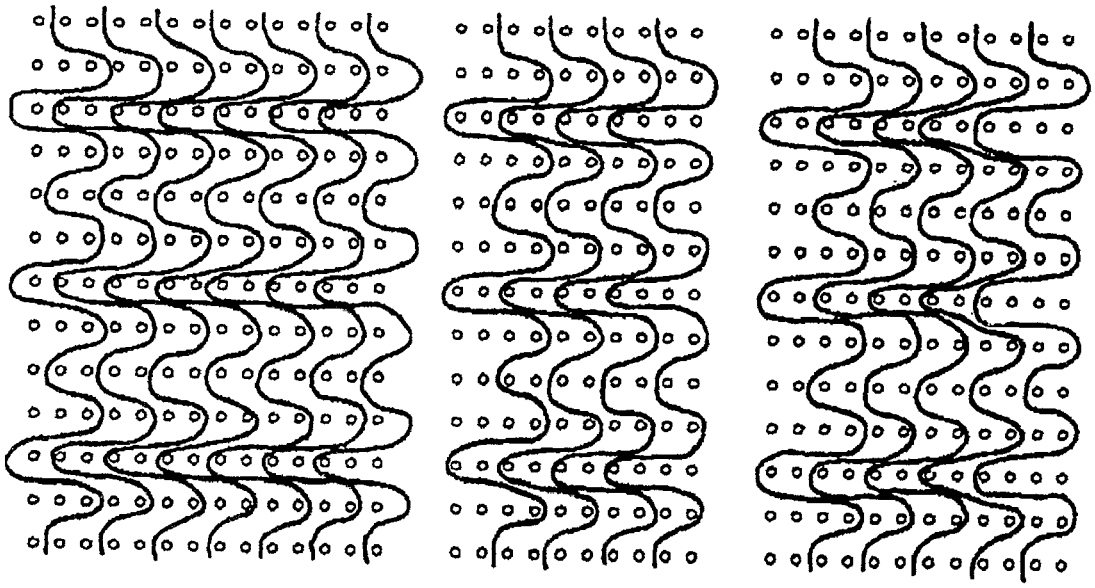
FIG. 4C is a stitch diagram illustrating bar number 3—weft yarn.
Figure 4D:
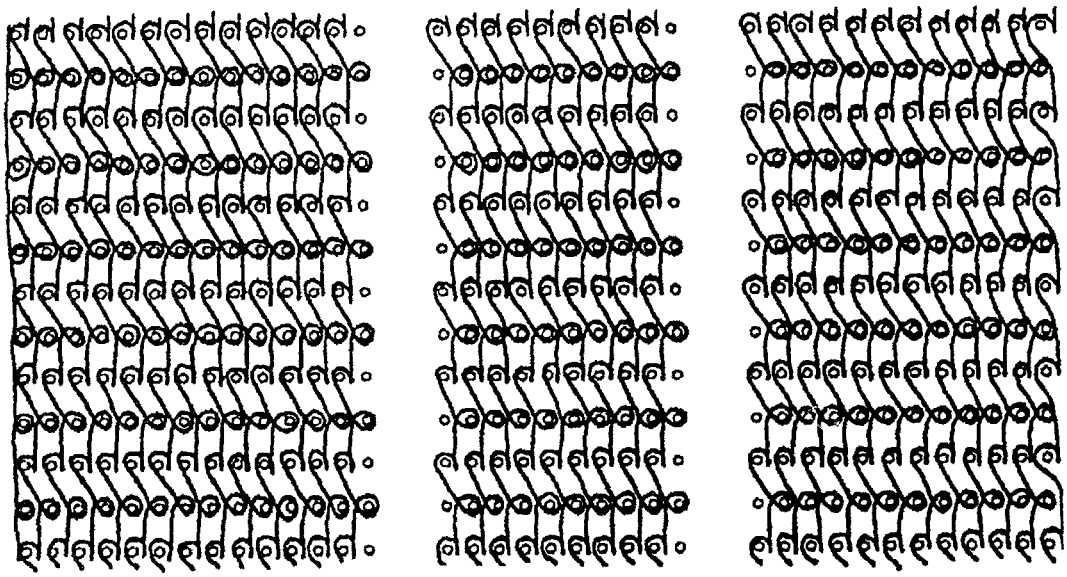
FIG. 4D is a stitch diagram illustrating bar number 4—warp yarn.

As can be seen in FIG. 3, the normal bearded needles of a crochet machine have been replaced by latch needles 20, needle guides 22 and a latch bar 24. This modification normally would result in interference in operation and result in broken needles. However, in the present invention, the guide pattern wheels use specifically modified lengthened lobes which increases the dwell time to prevent two-needle run-on and needle damage by increasing the dwell from about 18 degrees to about 26 degrees. The remainder of the operation of the crochet machine 10 is generally conventional with the weft threads 26 being fed through the inlay bars 30 and weft tubes 27. The warp yarn 34 is fed through the warp guide 36. The knitted fabric 40 then passes through the fabric take-down rollers 42 where it is then collected.

As best seen in FIG. 3 and FIGS. 4*a*–4*d*, bar 1 preferably includes either 100% cotton weft having 10 singles or 100% polyester having 200 denier or a 50/50 blend. Bar 2 is covered rubber yarns R between about 40 gauge and 26 gauge in size which is crocheted with a chain stitch without a weft yarn. Bar 3 is 100% cotton weft with 10 singles or 100% polyester 220 denier or a 50/50 blend similar to bar 1. Finally, bar 4 is a single 150 denier stretch polyester.

As can be seen, bar 1 weft yarn, which is the back bar, uses a 1-3/1-3 stitch threaded 1 in, 1 out. This moves over two needles and repeats. Bar 2, which is the rubber yarns R, uses a 1-1/2-2 movement threaded 1 in, 1 out at the edge portions and 1 in, 1 out for the body of the fabric, two on one side of the needle and two on the other side. Bar 3 is the weft front bar and uses a 1-3/1-5 stitch threaded 1 in, 1 out, which prevents warp yarn slippage. Finally, bar 4, which is the warp yarn, uses a tricot cam which uses an 0-1/1-2 stitch fully threaded on every needle to give a lock-stitch pattern. Preferably, a 92-needle setup is used with 32 ends of rubber yarns R. However, a 110-needle 40-end rubber yarns construction and other combinations could also be used.

Figure 5:
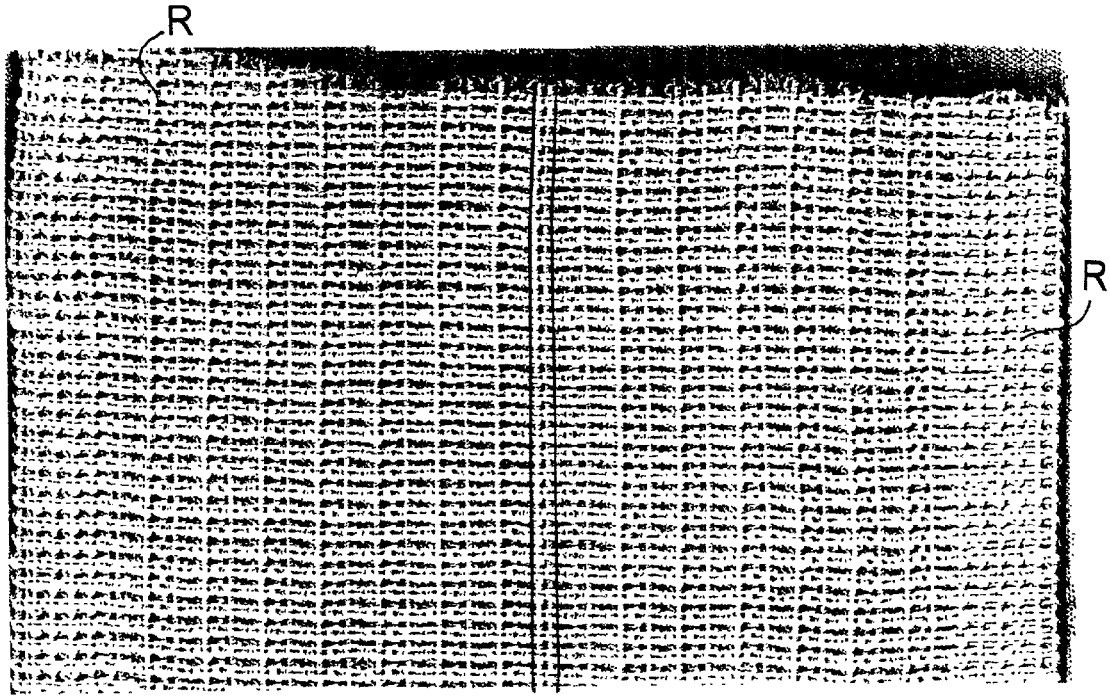
FIG. 5 is the top face of a knitted fabric used for the cleaning cloth of the present invention.
Figure 6:
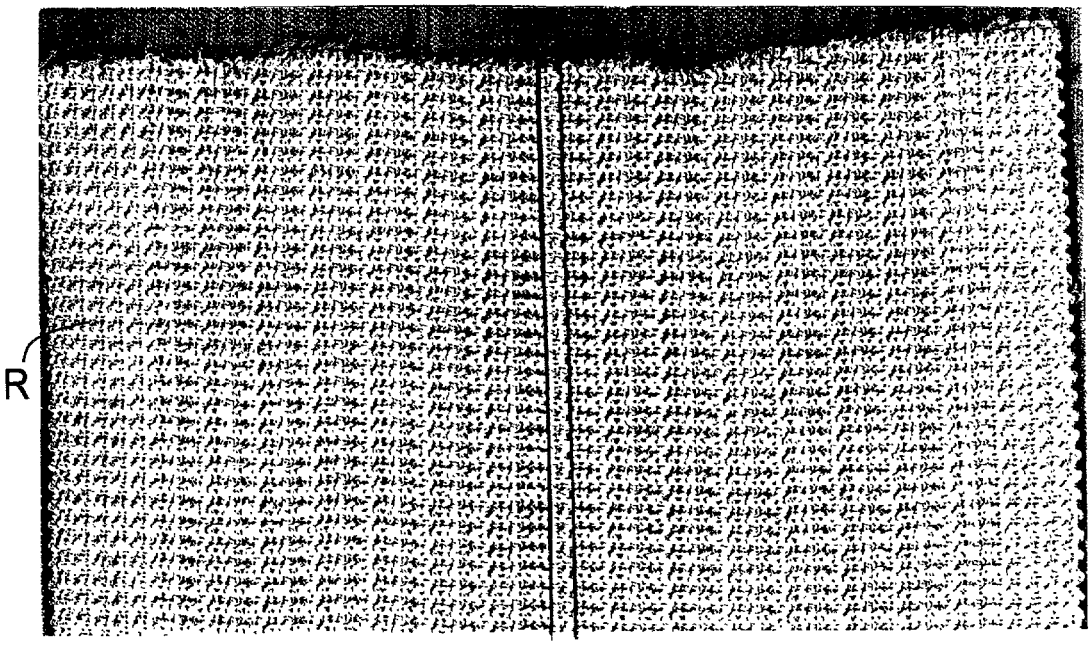
FIG. 6 is the bottom face of the knitted fabric shown in FIG. 5.

As best seen in FIGS. 5–6, six rubber yarns R are used on one end, a two-needle shift is used in the center to provide a centering line and five rubber yarns R are used on the right-hand side of the center. These edges using six rubber yarns on the left and five rubber yarns on the right are the same width but prevents curling in combination with a balanced upper and top and back face of the fabric. This produces a fabric which is more easily cut and fabricated into a final cloth C. In fact, since the fabric lays flat, this increases the efficiency of assembly up to 30%. In addition, the addition of the center needle pattern acts as a center marker to aid in assembly of cleaning cloth C.

The resulting knitted fabric is ravel-resistant because of the tricot knit, curl-free because of the flex knit and rubber yarns construction, and has 50–125% stretch in the width direction and 50–200% stretch in the length direction when tested according to a standard stretch chart. Also, because of the balance of the knit structure, the resulting fabric has a much higher drape value when compared to conventional fabric knitted on a V-bed knitting machine. And, as discussed above, the center marker design allows the fabric to be easily assembled because the closeness of the two rubber yarns acts as a marker indicating the center of the fabric. After knitting, the yarn is heat-set at 250°–300° F. This results in a shrinkage of 3–5% which is acceptable. The first and/or third bar may include a 50/50 blend of cotton weft having ten singles and polyester weft having 200 denier.

In the preferred embodiment, the construction of the cleaning cloth knitted fabric produced according to the present invention includes a fiber content of textured polyester with the elastomer being of extruded or synthetic rubber yarns between 40 gauge and 26 gauge in size. The resulting fabric has a bi-directional stretch of 130%±20 and shrinkage in the range less than 5%.

Because of the high output of the modified crochet knitting machine and the improved handleability of the resulting fabric, cleaning cloth C constructed according to the present invention is economical both in manufacture and in assembly.

Certain modifications and improvements will occur to those skilled in the art upon a reading of the foregoing description. By way of example, a variety of deniers or counts of different synthetic or natural yarns may be substituted to make the fabric for cleaning cloth C. Also, it is expected that additional modifications would allow beard or compound needles to be used. Finally, yarn may be supplied to the needles from the warp or weft positions. It should be understood that all such modifications and improvements have been deleted herein for the sake of conciseness and readability but are properly within the scope of the following claims.

It will be understood that various details of the invention may be changed without departing from the scope of the invention. Furthermore, the foregoing description is for the purpose of illustration only, and not for the purpose of limitation—the invention being defined by the claims.

What is claimed is:

1. A cleaning cloth for household and/or industrial use comprising:

(a) a knitted fabric cleaning cloth having a plurality of rubber yarns knitted therein and each being secured by another yarn extending thereover in a lock-stitch pattern, said knitted fabric cleaning cloth having a fabric stitch sequence comprising:

(i) a first bar of weft yarn, which is a back bar, and knitted using a 1-3/1-3 stitch and which is threaded 1 in, 1 out;

(ii) a second bar, which is a rubber yarn, and knitted using a 1-12/-2 stitch threaded 1 in, 1 out for side portions and 1 in, 2 out for any remaining portion;

(iii) a third bar of warp yarn, which is a front bar, and knitted using a 1-3/1-5 stitch and which is threaded 1 in, 1 out to prevent warp yarn slippage; and (iv) a fourth bar, which is a warp yarn, and knitted using a tricot cam using an 0-1/1-2 stitch threaded on every needle to give a lock stitch pattern.

(b) said plurality of rubber yarns extending generally parallel to each other as they traverse said fabric and being of sufficient relative diameter to said fabric to form spaced-apart rib elements therein; and (c) said plurality of rib elements of said knitted fabric are of a predetermined size so as to serve as wiper blades during use of said cleaning cloth to remove surface dirt and debris from a surface being cleaned.

2. The cleaning cloth according to claim 1 wherein said rubber yarns are covered rubber yarns.

3. The cleaning cloth according to claim 2 wherein said covered rubber yarns are between about 40 gauge and 26 gauge in size.

4. The cleaning cloth according to claim 1 wherein said knitted fabric includes a plurality of knitted yarns selected from the group consisting of: cotton yarns; polyester yarns; and blended cotton/polyester yarns.

5. The cleaning cloth according to claim 1 wherein said knitted fabric includes a first bar of weft yarn, a second bar of rubber yarn, a third bar of weft yarn and a fourth bar of warp yarn, said warp yarn serving to lock-stitch said rubber yarn into said knitted fabric.

6. The cleaning cloth according to claim 1 wherein said knitted fabric is knitted by a method selected from the group consisting of circular, flat bed, warp, crochet and v-bed knitting.

* * * * *